United States Patent [19]

Lee

[11] 4,173,383

[45] Nov. 6, 1979

[54] CONVERTER PLUG

[76] Inventor: Hop Lee, 2455 24th Ave., San Francisco, Calif. 94116

[21] Appl. No.: 937,470

[22] Filed: Aug. 28, 1978

[51] Int. Cl.[2] ..... H01R 3/06; H01R 13/54

[52] U.S. Cl. ..... 339/75 P; 339/14 P; 339/41; 339/189 R

[58] Field of Search ..... 339/14 P, 41, 42, 75 P, 339/78, 88 R, 90 R, 189 R

[56] References Cited

U.S. PATENT DOCUMENTS

| | | | |
|---|---|---|---|
| 3,525,971 | 8/1970 | Glassman | 339/14 P |
| 3,713,074 | 1/1973 | Pasbrig | 339/41 |
| 3,945,702 | 3/1976 | Poliak et al. | 339/88 R |

FOREIGN PATENT DOCUMENTS

| | | | |
|---|---|---|---|
| 140369 | 11/1948 | Australia | 339/41 |

*Primary Examiner*—E. F. Desmond

*Attorney, Agent, or Firm*—William R. Piper

[57] ABSTRACT

A converter plug which has two electrodes designed to be removably received in a standard electric outlet box and which has a "ground" terminal that may be swung into an inoperative and concealed position when the outlet box is not equipped with a socket for receiving the "ground" terminal. A "ground" wire is connected to the "ground" terminal and may be connected to the outlet box when the "ground" terminal is not used. The converter plug also has an adjustable locking disc with three openings for receiving the three fixed prongs of a standard self-locking electric plug. The two electrodes and the "ground" terminal each have a hook-shaped end adapted to receive and interlock with its associated hook-shaped end of the three prongs in the standard self locking electric plug when the latter has its three prongs inserted into the disc openings and the standard plug is rotated with respect to the converter plug into locked position.

2 Claims, 8 Drawing Figures

FIG. 1.
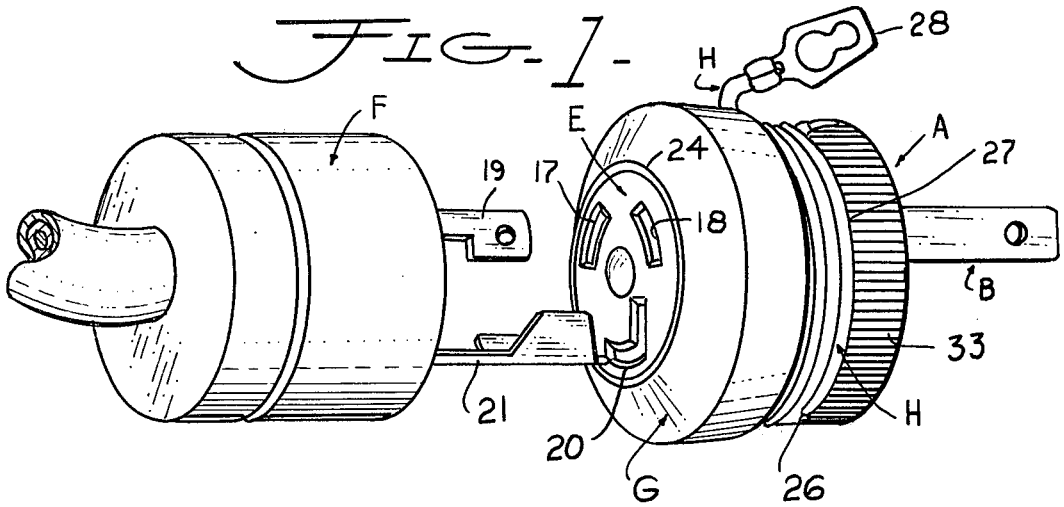
FIG. 3.
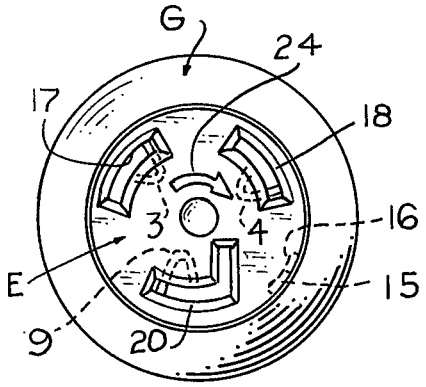
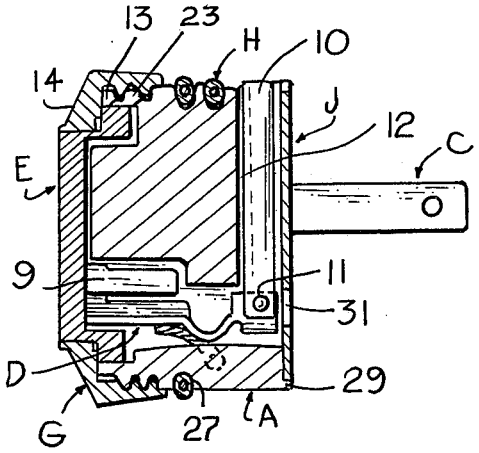
FIG. 2.
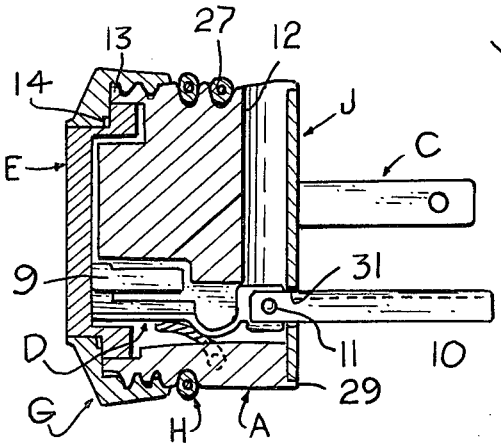
FIG. 4.

CONVERTER PLUG

SUMMARY OF THE INVENTION

An object of my invention is to provide a converter plug that has two electrodes for reception in a standard electric outlet box. The converter plug also has a "ground" terminal that can be swung into operative position when the outlet box has an opening for receiving the "ground" terminal. If the outlet box does not have such an opening then the "ground" terminal has a "ground" wire that may be attached to the outlet box and function as a "ground" wire.

A further object of my invention is to provide a locking disc for the converter plug that must be rotated into a certain position before a standard three prong plug can be connected to the converter plug. The two electrodes and the "ground" terminal of the converter plug are each provided with hook-shaped ends that are engaged by the hook-shaped outer ends of the three prongs of the standard plug when it is connected to the converter plug. Then the standard plug may be rotated with respect to the converter plug to cause the hook-shaped ends of the three prongs to interlock with the hook-shaped ends of the electrodes and "ground" terminal of the converter plug.

BRIEF DESCRIPTION OF THE DRAWINGS

FIG. 1 is an isometric view of the converter plug and illustrates a standard three prong plug about to be electrically connected to the converter plug.

FIG. 2 is a longitudinal section through the converter plug.

FIG. 3 is an end view of the converter plug and shows a face view of the locking disc.

FIG. 4 is a longitudinal section through the converter plug similar to FIG. 2, but showing the "ground" terminal in operative position whereas in FIG. 2 it is in inoperative position.

DESCRIPTION OF THE PREFERRED EMBODIMENT

Figure 5:
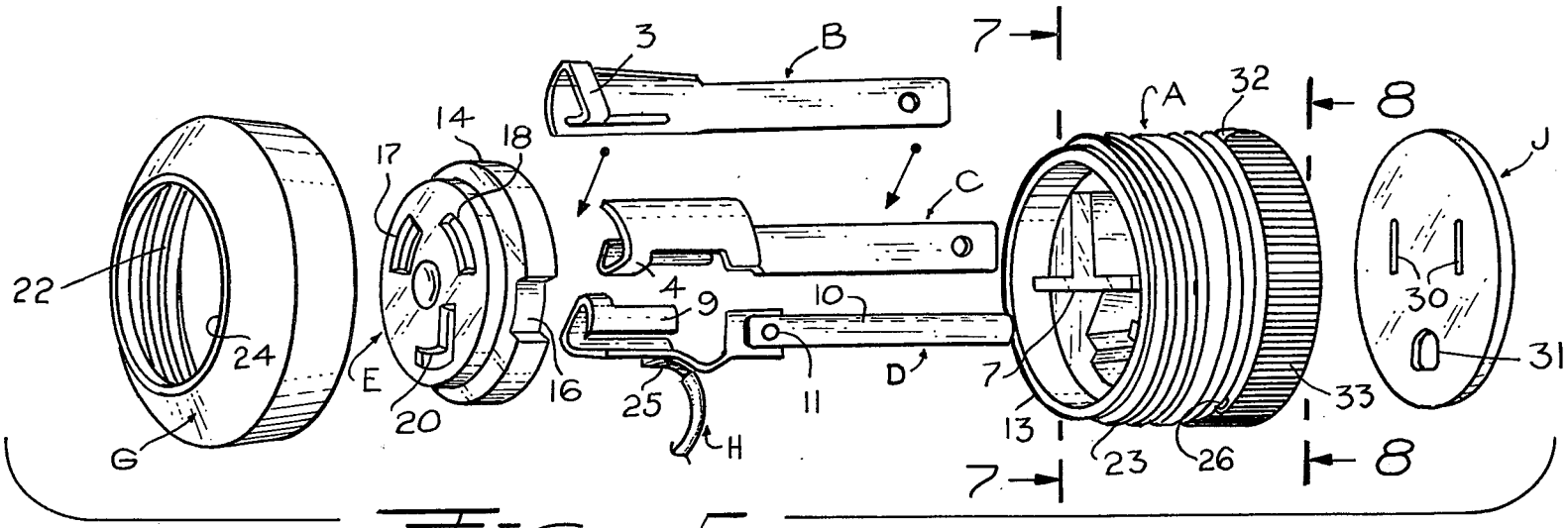
FIG. 5 is an exploded isometric view of all of the parts making up the converter plug.
Figure 8:
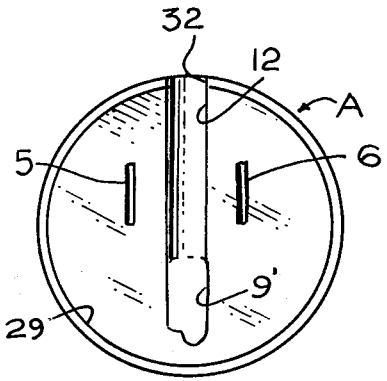
FIG. 8 is a view of the opposite end of the main body from that shown in FIG. 7, and when looking in the direction of the arrows 8—8 of FIG. 5. The insulating disc as well as the two electrodes and "ground" terminal are not shown in FIG. 8.
Figure 7:
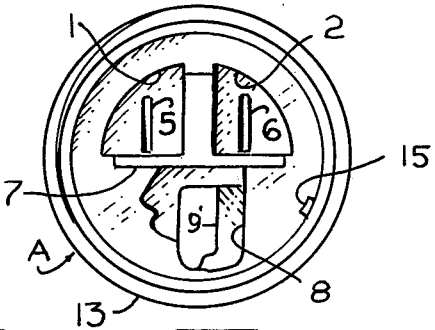
FIG. 7 is a view of the main body of the converter plug when looking in the direction of the arrows 7—7 in FIG. 5. The main body is shown with the two electrodes and the "ground" terminal removed therefrom.

In carrying out my invention I provide a main body for the converter plug and this is shown in the exploded view at A, in FIG. 5 and opposite end views of the same body are shown in FIGS. 7 and 8. The end view of FIG. 7 shows the main body without the two electrodes and the "ground" terminal and it has two recesses 1 and 2 for receiving the hook-shaped ends 3 and 4 of the two electrodes B, and C, shown in FIG. 5. At the inner ends of the two recesses 1 and 2 in the main body A, I show slots 5 and 6 that extend through the closed end of the body and receive the ends of the two electrodes B and C. The main body has a T-shaped projection 7, see FIGS. 5 and 7 and this projection prevents the two hook-shaped ends of the two electrodes B and C, from contacting each other. FIG. 7, further shows the main body A provided with another recess 8 for receiving the hook-shaped end 9 of the "ground" terminal D, shown in FIG. 5. Also, the main body has an opening 9′ extending from the inner end of the recess 8 and terminating at the opposite end of the main body as shown in FIG. 8. This opening 9′ receives a base portion of the "ground" terminal D, and the prong 10 of the "ground" terminal is pivoted at 11 to the base portion and when this prong is swung into retracted or inoperative position as shown in FIG. 2, the end of the main body shown in FIG. 8 has a groove 12 for receiving the prong.

The main body A has a cylindrical rim 13 that extends beyond the outer end of the T-shaped projection 7, see FIG. 5, and the longitudinal space between the projection 7 and the plane of the circular rim 13 is sufficient to receive a rotary locking disc E, shown in isometric in the same FIG. 5. This locking disc has an annular flange 14 whose outer periphery is of the same diameter as the inner diameter of the circular rim 13 of the main body. This permits the locking disc E to be received in the rim 13. FIG. 7 shows the rim 13 of the main body A provided with an inwardly extending projection 15 and the annular flange 14 on the disc E has a recess 16, see FIG. 5, that receives the projection 15 and limits the rotation of the disc with respect to the rim 13. FIGS. 1, 3 and 5 show the disc with two arcuate-shaped openings 17 and 18 for receiving two of the prongs 19 of the standard three pronged plug F, shown in FIG. 1, only one of these two prongs being shown in this Figure.

Both FIGS. 1 and 5 further show the disc E with an L-shaped opening 20 and this opening receives the third prong 21 on the standard plug F which has its outer end L-shaped in cross section so as to fit into the L-shaped slot 20 in the disc when the standard plug is electrically connected to the converter plug. When the two electrodes B and C, are mounted in the recesses 1 and 2 in the main body A, their hook-shaped ends 3 and 4 will lie adjacent to the inner surface of the disc E. In FIG. 3 I show in dotted lines the ends of the hook-shaped portions 3 and 4. Also, when the "ground" terminal D, is mounted in the recess 8 in the main body A, its hook-shaped end 9 will lie adjacent to the inner surface of the disc E and FIG. 3 shows in dotted lines this hook-shaped end.

The rockable disc E provides novel means for preventing the coupling of the standard three prong plug F to the converter plug unless the disc has been rotated counterclockwise with respect to the main body A, until the projection 15 on the rim 13 reaches the end of the recess 16 which is the position shown in FIG. 3. It is important to state that the disc E is rotatably held in place in the main body A by a cap G, shown in an isometric view in FIG. 5. The end cap G has a rim internally threaded at 22 that receives the external threads 23 on the rim 13 of the main body. The end cap G also has a central opening 24 that will receive the disc E and the annular flange 14 of the disc will underlie the adjacent inner surface of the end cap. In this manner the end cap will rotatably secure the disc E to the main body A.

It will be seen from FIG. 3 that when the disc E, is in the position shown, it will not only permit the two prongs 19 of the standard three prong plug to enter the openings 17 and 18, but will also permit the hook-shaped end of the prong 21 to enter the L-shaped opening 20 because the hook-shaped end 9 of the "ground" terminal D, shown by dotted lines in FIG. 3, is in this position. As soon as the end of the standard plug F, is moved into abutting position with respect to the converter plug, the operator can rotate the standard plug clockwise which will cause its three prongs to rotate the disc E, clockwise as shown by the arrow 24 on the disc. This rotative movement will cause the hook-shaped ends of the three prongs on the standard plug to interlock with the hook-shaped ends of the two electrodes B and C, and with the "ground" terminal D, and will prevent the accidental disengagement of the standard plug from the converter plug. It requires a reverse or counterclockwise rotation of the standard plug with respect to the converter plug before disengagement between the two can take place.

Figure 6:
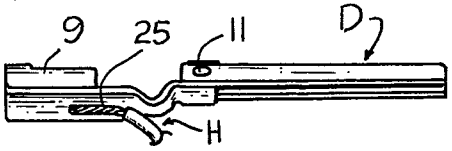
FIG. 6 is a perspective view of the "ground" terminal and shows how the "ground" wire is soldered thereto.

The "ground" terminal is illustrated in both FIGS. 5 and 6, and it has a "ground" wire H, soldered to it at 25. The wire H, is passed through an opening 26 in the main body A, see FIGS. 1 and 5, and when the "ground" terminal D, is in retracted or inoperative position as shown in FIG. 2, the wire is wrapped in a helical groove 27 formed in the main body A, and the side walls of the groove will grip the wire to hold it from accidental removal. The end of the wire H has a metal member 28, see FIG. 1, with a key hole slot in it by which the member can be connected to an outlet box when the "ground" terminal is in retracted position.

FIG. 8, shows an annular flange 29, for receiving an insulating disc J. This disc has two openings 30 which will register with the two slots 5 and 6 in the main body A, and it has a third opening 31 that will receive the pivoted prong 10 of the "ground" terminal D, when the prong is in operative position. The annular flange 29 has a cut-away portion 32, see FIG. 8 for receiving the end of the prong 10 when the latter is retracted as shown in FIG. 2. The outer surface of the main body A has a portion that is knurled as shown at 33 in FIGS. 1 and 5.

FIG. 2 shows the "ground" terminal D with its prong 10 in retracted position and the insulating disc J, covering the prong. The "ground" wire H, would be used and connected to the outlet box, not shown. When the "ground" terminal D, is in operative position as shown in FIG. 4, then the "ground" wire H, is not used.

I claim:

1. A converter plug comprising:

(a) a main body with two recesses to receive the hook-shaped ends of two electrodes and a third recess to receive the hook-shaped end of a "ground" terminal;

(b) a pair of electrodes having hook-shaped ends and a "ground" terminal having a hook-shaped end mounted in the three recesses;

(c) a locking disc rockably mounted in said main body and covering the hook-shaped ends of the two electrodes and said "ground" terminal, said disc having two arcuate slots for receiving two prongs of a standard three prong plug, the disc also having an L-shaped slot for receiving the hook-shaped end of a third prong on the standard plug; and (d) means for limiting the rotation of said disc with respect to said main body when the three slots in the disc are substantially out of registry with the hook-shaped ends of the two electrodes and "ground" terminal so that the three prongs of the standard plug can enter the three slots in the disc, the three hook-shaped ends of the three prong standard plug interlocking with the hook-shaped ends of the two electrodes and "ground" terminal when the standard plug is rotated with respect to the main body a predetermined distance for electrically connecting the standard plug to the main body of the converter plug.

2. The combination as set forth in claim 1: and in which (a) the means for limiting the rotative movement of said disc with respect to the main body consists of an inwardly extending projection in the main body being received in an elongated recess in the rim of said disc, whereby the rotation of said disc to the main body is limited to moving the three slots in the disc substantially out of registration with the hook-shaped ends of the two electrodes and "ground" terminal in the main body to permit the entrance of the three prongs in the standard plug to enter the three openings and the subsequent rotation of the standard plug with respect to the main body for moving the hook-shaped ends of the three prongs of the standard plug into interlocking engagement with the hook-shaped ends of the two electrodes and the "ground" terminal.

* * * * *